United States Patent [19]

Kerzman et al.

[11] 3,974,775

[45] Aug. 17, 1976

[54] WAD UNIT FOR SHOTGUN SHELL

[76] Inventors: Jack A. Kerzman, 18606 E. Leadora, Glendora, Calif. 91740; Helmut Rail, 2011 Mission St., South Pasadena, Calif. 91030

[22] Filed: Nov. 4, 1974

[21] Appl. No.: 520,358

[52] U.S. Cl. ..... 102/95; 102/42 C

[51] Int. Cl.[2] ..... F42B 7/08

[58] Field of Search ..... 102/42 C, 95

[56] References Cited

UNITED STATES PATENTS

| | | | |
|---|---|---|---|
| 3,289,586 | 12/1966 | Horn et al. | 102/42 C |
| 3,565,010 | 6/1968 | Sahlmann | 102/95 |
| 3,722,420 | 11/1970 | Herter | 102/95 |
| 3,728,966 | 4/1973 | Woodring | 102/42 C |
| 3,835,783 | 9/1974 | Curran | 102/42 C |

*Primary Examiner*—Verlin R. Pendegrass
*Attorney, Agent, or Firm*—William W. Haefliger

[57] ABSTRACT

A shotgun shell wad comprises a. a downwardly opening cup having a zone adapted to receive an explosive charge, the cup having a transverse base above said zone and a depending annular skirt, b. an upright plunger carried by the base, and c. multiple circularly spaced upwardly elongated leaves carried by and projecting upwardly from the plunger to be flexed inwardly and form with the plunger a pellet chamber, d. said wad consisting of molded plastic material and the plunger tapering downwardly toward the base to deform the base centrally downwardly relative to the skirt in response to detonation of the charge.

9 Claims, 5 Drawing Figures

WAD UNIT FOR SHOTGUN SHELL

BACKGROUND OF THE INVENTION

This invention relates generally to the construction and operation of shotgun shell wads, more particularly it concerns a simple wad configuration of unusual effectiveness.

There is a continuing need for improvement in the construction and operation of shotgun shell wads, to the end that they will effectively cushion the reaction force or recoil developed upon explosion of the charge, and will effectively dampen the explosive force transmitted to the shot pellets. Also, wads must be simple and easy to mold and use. No prior wad, to any knowledge, embodies all of the above desirable features as well as others in the unusually advantageous structure, mode of operation and results as now afforded by the invention.

SUMMARY OF THE INVENTION

Basically, the wad of the present invention comprises a. a downwardly opening cup having a zone adapted to receive an explosive charge, the cup having a transverse base above said zone and depending annular skirt, b. an upright plunger carried by the base, and c. multiple circularly space upwardly elongated leaves carried by and projecting upwardly from the plunger to be flexed inwardly and form with the plunger a pellet chamber, d. said wad consisting of molded plastic material and the plunger tapering downwardly toward the base to deform the base centrally downwardly relative to the skirt in response to detonation of the charge.

As will appear, the cup, plunger and leaves or fingers are preferably of one-piece molded plastic construction; the leaves project upwardly an outwardly in unflexed molded state to accommodate maximum in-filling of shot pellets; the upper surface of the base is tapered downwardly to assist cushioning; and the plunger lower extent and base central region are deformed downwardly and permanently into the cup powder zone, after charge explosion.

These and other objects and advantages of the invention, as well as the details of an illustrative embodiment, will be more fully understood from the following description and drawings, in which:

DRAWING DESCRIPTION

DETAILED DESCRIPTION

Figure 1:
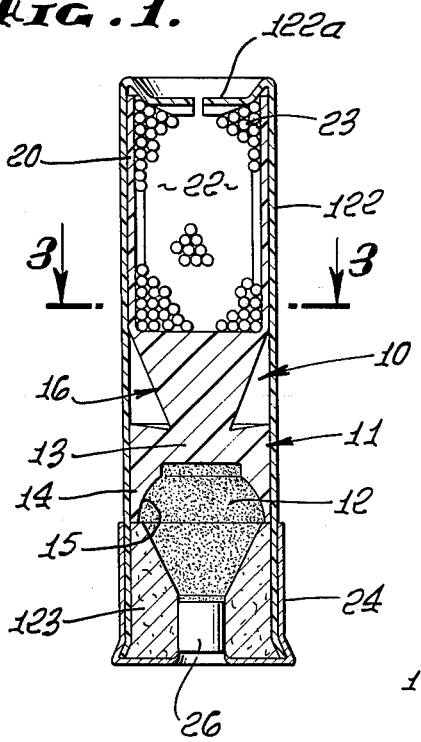
FIG. 1 is a vertical section through a shotgun shell containing a wad embodying the invention.
Figure 2:
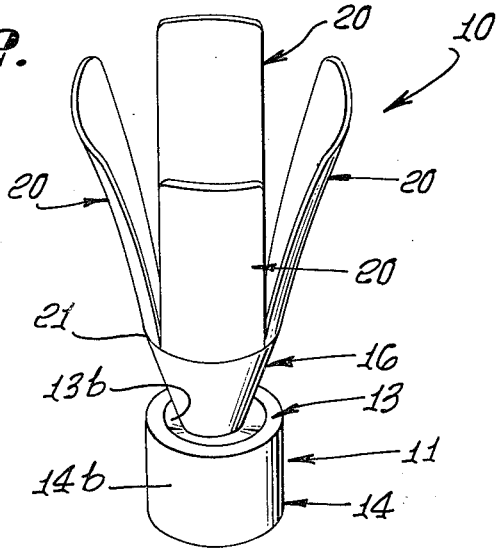
FIG. 2 is an enlarged perspective showing the wad in as-molded condition.

In FIGS. 1–4, the wad 10 includes a downwardly opening cup 11 adapted to receive an explosive charge, such as the powder appearing at 12 in FIG. 1. The cup has an upper transverse base 13 and a depending annular skirt 14, the inner surface **14*a* of the latter tapering downwardly and outwardly toward the outer cylindrical surface 14*b*. The interior of the cup is designated at 15**.

The wad also includes an upright plunger 16 carried by the base 13, the plunger and base extending coaxially as respects central axis 17. Preferably, the plunger tapers downwardly and is integral with the base at a central region **13*a* spaced directly above the open interior of the cup. Also, the upper annular surface of the base about the tapered plunger is preferably downwardly and inwardly tapered at 13*b* to facilitate downward deformation of the central region 13*a* of the base, i.e. to FIG. 5 condition, and relative to the skirt, in response to detonation of the explosive charge during use of the shell 10**. Conversely, the construction facilitates upward deformation of the skirt relative to the base and plunger, in response to such detonation. As a result, the reaction force of the detonation is cushioned to greater and more effective extent than in current shells, by such forcible deformation, whereby utility of the shotgun employing the shell is enhanced. Also, such deformation does not interfere with the pellet chamber, to be described.

Figure 3:
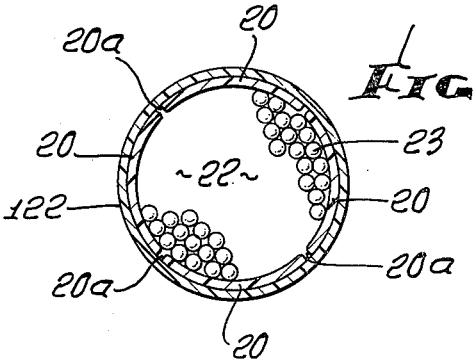
FIG. 3 is a horizontal section in lines 3-3 of FIG. 1.
Figure 4:
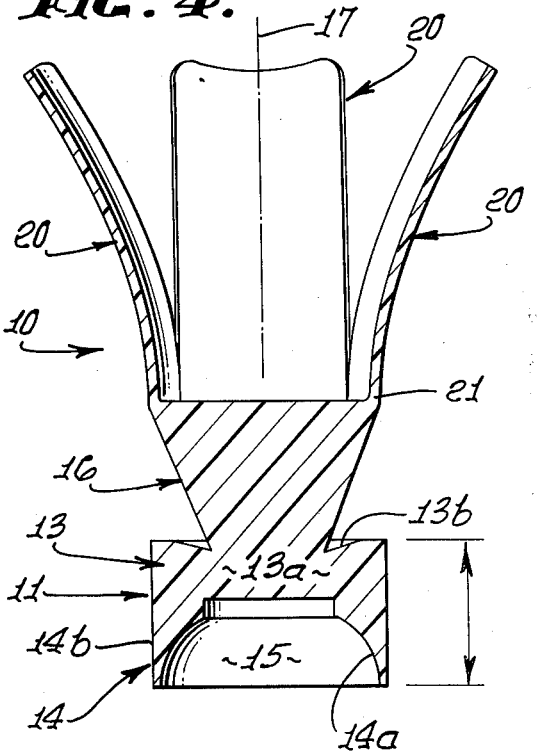
FIG. 4 is a further enlarged elevation, in section, showing the wad of FIG. 2.

The wad also includes multiple, circularly space upwardly elongated thin-walled leaves or fingers carried by and projecting upwardly from the plunger, at its periphery. Typical leaves or fingers are indicated at 20 and are shown as integral with the plunger 16 at its upper periphery 21. Accordingly, the leaves have cantilever connection with the plunger, to be flexed inwardly and to form with the plunger a pellet chamber 22 as seen in FIGS. 1 and 3. Note the shot pellets 23 confined in that chamber, the longitudinal edges **20*a* of the upright inwardly flexed leaves being in close adjacency. For such leaves are preferably employed, and they are alike, they project upwardly and outwardly in unflexed state, as in FIGS. 2, 4 and 5, and they are concave toward axis 17 in plane normal to that axis. Accordingly, maximum shot can be filled into chamber 22**.

FIG. 1 shows a shotgun shell casing or sleeve 122 encompassing the wad, holding the leaves in inwardly flexed condition to form the pellet chamber. In this regard, the wad is easily inserted endwise downwardly into the sleeve, to seat on an annular filler or insert 123. The top of the sleeve is deformed or crimped inwardly at **122*a* to close the pellet chamber and retain the pellets, and metallic cup 24 is received about the lower end portion of the sleeve to retain the insert. Explosive charge 12 such as gunpowder fills the interior 15 of the cup as well as the upper interior of the annular insert 123. A detonator 26** is retained in position as shown.

Suitable plastic material that is compressible, flexible and deformable is employed for the wad, one plastic being polyethylene. The sleeve or case 122 may consist of paper, metal or plastic.

Figure 5:
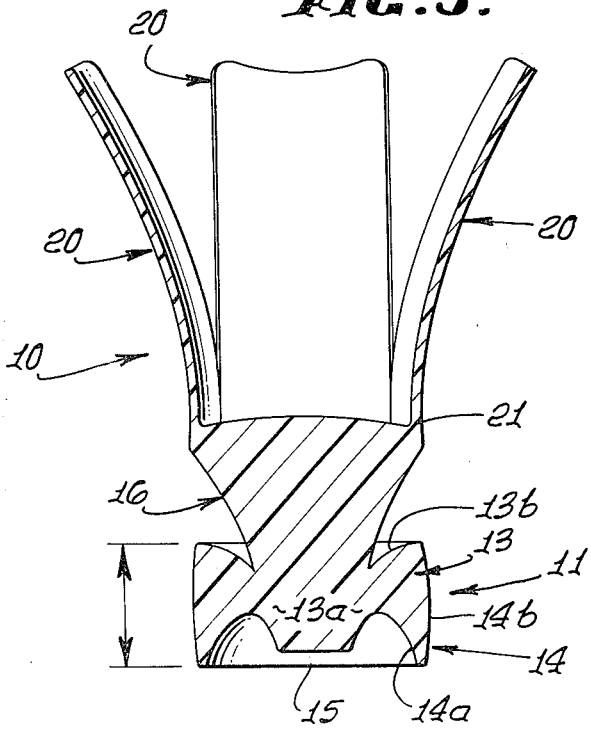
FIG. 5 is a view like FIG. 4 showing the wad after detonation of the charge.

Note in FIG. 5 that annular surface **13*b* is deformed to curve sharply downwardly, and is elongated; also, the plunger has permanently deformed the base central region 13*a* into the cup hollow 15**. The tapered configuration of the plunger not only cooperates with the cup base to effectively cushion the reaction force transmitted as recoil, but also very effectively transmits the full force of the exploding charge to the pellets by virture of its upwardly diverging configuration.

We claim:

1. In a wad for a shotgun shell, a. an axially downwardly opening cup having a zone adapted to receive an explosive charge, the cup having a transverse base directly above said zone and a depending annular skirt, b. an upright central plunger carried by the base, and c. multiple circularly spaced upwardly elongated leaves carried by and projecting upwardly from the plunger to be flexed inwardly and form with the plunger a pellet chamber, d. said wad consisting of molded plastic material and the plunger having frusto-conical configuration and tapering downwardly toward the base to deform the base centrally downwardly relative to the skirt in response to detonation of the charge, the lowermost and narrowest extent of the plunger projecting downwardly to integrally merge with the base at a first locus centrally of the base, the base having reduced axial thickness at an annular second locus immediately about said first locus to be structurally weakened at said second locus, the base, at said second locus, forming a recess opening upwardly annularly about said lowermost and narrowest extent of the plunger, the uppermost radially outer extent of said frusto-conical plunger extending in axial alignment with said cup annular skirt.

2. The wad of claim 1 wherein the cup, plunger and leaves form an integral, one-piece unit.

3. The wad of claim 2 wherein the base below said recess has an annular upper surface about the plunger, said upper surface being downwardly and inwardly tapered.

4. The wad of claim 2 wherein said cup and plunger have a common upright axis, said leaves being concave toward said axis in planes normal to said axis.

5. The wad of claim 2 wherein said leaves in unflexed state project upwardly and outwardly.

6. The wad of claim 5 wherein there are four of said leaves.

7. The wad of claim 2 including a shell sleeve encompassing said wad holding leaves in inwardly flexed condition to form said chamber, there being pellets in said chamber.

8. The wad and sleeve of claim 7 wherein the sleeve projects below the level of the cup, there being an insert directly below the cup and encompassed by the sleeve, and there being said explosive charge confined within the cup.

9. The wad of claim 1 wherein the wad is free of structure radially outwardly of the plunger.

* * * * *